US009847571B2

(12) United States Patent
Bit-Babik et al.

(10) Patent No.: US 9,847,571 B2
(45) Date of Patent: Dec. 19, 2017

(54) COMPACT, MULTI-PORT, MIMO ANTENNA WITH HIGH PORT ISOLATION AND LOW PATTERN CORRELATION AND METHOD OF MAKING SAME

(71) Applicant: SYMBOL TECHNOLOGIES, INC., Lincolnshire, IL (US)

(72) Inventors: Giorgi Bit-Babik, Plantation, FL (US); Antonio Faraone, Fort Lauderdale, FL (US)

(73) Assignee: Symbol Technologies, LLC, Holtsville, NY (US)

( * ) Notice: Subject to any disclaimer, the term of this patent is extended or adjusted under 35 U.S.C. 154(b) by 350 days.

(21) Appl. No.: 14/073,177

(22) Filed: Nov. 6, 2013

(65) Prior Publication Data

US 2015/0123868 A1 May 7, 2015

(51) Int. Cl.
*H01Q 9/04* (2006.01)
*H01Q 1/52* (2006.01)
(Continued)

(52) U.S. Cl.
CPC ..... *H01Q 1/521* (2013.01); *H01Q 9/0464* (2013.01); *H01Q 21/28* (2013.01); *H01Q 1/243* (2013.01); *H01Q 3/247* (2013.01); *H01Q 9/28* (2013.01); *H01Q 21/065* (2013.01); *H01Q 25/005* (2013.01); *Y10T 29/49016* (2015.01)

(58) Field of Classification Search
CPC ..... H01Q 9/0464; H01Q 21/0006; H01Q 21/0087; H01Q 3/247; H01Q 19/10; H01Q 25/005; H01Q 21/065; H01Q 25/0005; H01Q 7/00; H01Q 21/24; H01Q 9/16; H01Q 1/241–1/243; H01Q 9/265; H01Q 9/28; H01Q 21/20
USPC ..... 343/700 MS, 750, 855, 857, 769, 702, 343/790, 844, 873, 866, 867, 741–743, 343/726, 728, 732, 748, 764, 788, 842
See application file for complete search history.

(56) References Cited

U.S. PATENT DOCUMENTS 2,217,911 A 10/1940 Lindenblad
2,562,332 A 7/1951 Riblet
(Continued)

FOREIGN PATENT DOCUMENTS

AU 199059089 1/1991
AU 2007234730 A1 10/2007
(Continued)

OTHER PUBLICATIONS

Arun Raaza and Amit Mehta, "Multiple Beams Scanning Double Square Loop Antenna for UWB Communications" IEEE 2010.
(Continued)

*Primary Examiner* — Hoang Nguyen
*Assistant Examiner* — Awat Salih

(57) ABSTRACT

An antenna includes a ground support, an electrically conductive, endless element mounted at a distance relative to the ground support, and a trio of ports arranged along the endless element for conveying radio frequency signals in an operating band of frequencies. The antenna is compact and has high port isolation and low pattern correlation due to successively spacing the ports apart along the endless element by a spacing of one-half of a guided wavelength at a center frequency of the operating band.

16 Claims, 5 Drawing Sheets

(51) Int. Cl.

| | |
|---|---|
| ***H01Q 21/28*** | (2006.01) |
| *H01Q 1/24* | (2006.01) |
| *H01Q 9/28* | (2006.01) |
| *H01Q 3/24* | (2006.01) |
| *H01Q 21/06* | (2006.01) |
| *H01Q 25/00* | (2006.01) |

(56) References Cited

U.S. PATENT DOCUMENTS 2,716,191 A * 8/1955 Bartuska, Jr. ..... H01Q 9/265 343/818
3,022,506 A 2/1962 Goebels
3,063,049 A 11/1962 Kelly
3,299,428 A * 1/1967 Tessari, III ..... H01Q 21/29 343/743
3,417,400 A 12/1968 Black
3,626,418 A * 12/1971 Berryman, Jr. ..... H01Q 9/28 343/742
3,665,480 A 5/1972 Fassett
3,680,112 A * 7/1972 Thomas ..... H01Q 3/2647 342/370
3,713,167 A 1/1973 David
4,200,873 A 4/1980 Seeley
4,491,977 A 1/1985 Paul
4,608,572 A * 8/1986 Blakney ..... H01Q 1/48 343/792.5
4,994,817 A 2/1991 Munson
4,994,820 A * 2/1991 Suzuki ..... H01Q 1/3275 343/700 MS
5,061,939 A * 10/1991 Nakase ..... H01Q 9/0414 343/700 MS
5,523,767 A * 6/1996 McCorkle ..... H01Q 9/28 343/810
5,539,418 A * 7/1996 Egashira ..... H01Q 1/3275 343/712
5,675,346 A 10/1997 Nishikawa et al.
5,694,136 A * 12/1997 Westfall ..... H01Q 1/38 343/700 MS
5,864,318 A * 1/1999 Cosenza ..... H01Q 1/32 343/700 MS
5,986,615 A * 11/1999 Westfall ..... H01Q 1/48 343/700 MS
6,014,114 A * 1/2000 Westfall ..... H01Q 1/48 343/700 MS
6,124,833 A 9/2000 Bialkowski
6,473,048 B1 10/2002 Diaz
6,816,122 B2 11/2004 Noro
7,057,558 B2 * 6/2006 Fukushima ..... H01Q 9/0478 343/700 MS
7,283,101 B2 * 10/2007 Bisiules ..... H01Q 1/246 343/700 MS
7,420,525 B2 9/2008 Colburn et al.
7,570,219 B1 * 8/2009 Paulsen et al. ..... 343/708
8,159,394 B2 4/2012 Hayes et al.
8,228,258 B2 * 7/2012 Montgomery ..... H01Q 7/00 343/795
8,339,324 B1 * 12/2012 Dufilie ..... H01Q 1/42 343/725
8,344,820 B1 1/2013 Chen et al.
8,599,083 B2 * 12/2013 Lindenmeier ..... H01Q 7/00 343/741
8,681,063 B2 * 3/2014 Endou ..... H01Q 1/243 343/741
8,723,731 B2 * 5/2014 Tatarnikov ..... H01Q 1/241 343/700 MS
8,847,832 B2 * 9/2014 Parsche ..... H01Q 7/00 343/732
9,331,388 B2 * 5/2016 Lindenmeier ..... H01Q 7/00
9,484,634 B1 * 11/2016 Behroozi ..... H01Q 9/16
9,608,323 B1 * 3/2017 Berens ..... H01Q 1/50
2003/0107524 A1 * 6/2003 Hart ..... H01Q 21/24 343/860
2005/0140557 A1 * 6/2005 Kuroda ..... H01Q 1/38 343/773
2006/0232490 A1 10/2006 Bisiules
2007/0085743 A1 * 4/2007 Eberhardt ..... H01Q 1/243 343/700 MS
2007/0205952 A1 * 9/2007 Deng ..... H01Q 1/246 343/795
2007/0216595 A1 * 9/2007 Hashiyama ..... H01Q 19/09 343/848
2008/0048867 A1 * 2/2008 Oliver ..... H01Q 1/22 340/572.7
2008/0180254 A1 7/2008 Kajander
2008/0204326 A1 8/2008 Zeinolabedin et al.
2009/0046026 A1 * 2/2009 Nakano ..... H01Q 7/00 343/741
2009/0096699 A1 4/2009 Chiu et al.
2009/0146902 A1 * 6/2009 Li ..... H01Q 21/061 343/867
2009/0237314 A1 * 9/2009 Lalezari ..... H01Q 21/10 343/721
2009/0289865 A1 * 11/2009 Parsche ..... H01Q 9/28 343/772
2010/0214177 A1 8/2010 Parsche
2010/0231475 A1 9/2010 Ou et al.
2010/0253587 A1 * 10/2010 Lindenmeier ..... H01Q 7/00 343/797
2012/0068903 A1 * 3/2012 Thevenard ..... H01Q 3/247 343/795
2012/0075163 A1 * 3/2012 Nilsson ..... H01Q 1/2258 343/893
2012/0139806 A1 6/2012 Zhan et al.
2012/0212383 A1 8/2012 Sengupta
2012/0218157 A1 8/2012 Endou et al.
2013/0076584 A1 * 3/2013 Wong ..... H01Q 1/007 343/786
2013/0093641 A1 * 4/2013 Ng ..... H01Q 1/521 343/841
2013/0278475 A1 10/2013 Sabielny
2014/0266956 A1 * 9/2014 Rankin ..... H01Q 15/14 343/837
2014/0347243 A1 * 11/2014 Abadi ..... H01Q 9/0421 343/860
2015/0011168 A1 * 1/2015 Chen ..... H01P 1/36 455/73
2015/0255874 A1 * 9/2015 Hung ..... H01Q 5/357 343/786
2015/0357720 A1 * 12/2015 Chen ..... H01Q 1/521 343/727
2016/0043472 A1 * 2/2016 Fasenfest ..... H01Q 13/02 343/786
2016/0056542 A1 2/2016 Faraone et al.
2016/0226145 A1 * 8/2016 Xu ..... H01Q 9/28
2017/0025750 A1 * 1/2017 Su ..... H01Q 1/36

FOREIGN PATENT DOCUMENTS

| | | | | |
|---|---|---|---|---|
| EP | 1437795 | A1 | | 7/2004 |
| EP | 1 830 485 | A1 | | 9/2007 |
| EP | 2 221 915 | A1 | | 8/2010 |
| EP | 2 372 839 | A1 | | 10/2011 |
| EP | 2693565 | A1 | | 2/2014 |
| GB | 1529776 | | | 6/1977 |
| JP | H02 65505 | | | 3/1990 |
| JP | 200892491 | | * | 4/2008 |
| JP | 4744411 | B2 | | 8/2011 |
| WO | 2009142895 | A2 | | 11/2009 |
| WO | 2012055883 | | | 5/2012 |
| WO | WO2016028475 | | * | 2/2016 |

OTHER PUBLICATIONS

The United States Patent and Trademark Office, "Non-Final Office Action," issued in connection with U.S. Appl. No. 14/225,558 dated Apr. 20, 2016.

(56) References Cited

OTHER PUBLICATIONS

The United States Patent and Trademark Office, "Non-Final Office Action," issued in connection with U.S. Appl. No. 14/225,558 dated Sep. 29, 2015.

Rajagopalan et al., "Dielectric and Conductor Loss Quantification for Miscrstrip Reflectarray: Simulations and Measurement," IEEE Transactions on Antennas and Propagation, vol. 56, No. 4, Apr. 2008, pp. 1192-1196.

International Search Report and Written Opinion of the International Searching Authority issued in connection with International App. No. PCT/US2014/062162 dated Feb. 2, 2015.

Parker G. et al.: "A dual polarized microstrip ring antenna with good isolation," Antennas and Propagation Society International Symposium, 1997. IEEE Digest Montreal, Que., Canada Jul. 13-18, 1997, New York, NY, USA, IEEEE, US vol. 2, Jul. 13, 1997, pp. 928-931, XP010246970 DOI: 10.1109/APS.1997.631679, ISBN: 978-0-7803-4178-4.

The United States Patent and Trademark Office, "Non-Final Office Action," issued in connection with U.S. Appl. No. 14/462,762 dated Feb. 3, 2016.

The United States Patent and Trademark Office, "Final Office Action," issued in connection with U.S. Appl. No. 14/225,558 dated Oct. 18, 2016.

Office Action for Canadian Patent Application No. 2928416 dated Mar. 8, 2017.

German Office Action for German Application No. 112014005080.6 dated Jul. 13, 2016.

Office Action for GB Patent Application No. 1607368.6 dated Sep. 5, 2017.

The United States Patent and Trademark Office, "Non-Final Office Action," issued in connection with U.S. Appl. No. 14/225,558 dated Oct. 10, 2017.

* cited by examiner

COMPACT, MULTI-PORT, MIMO ANTENNA WITH HIGH PORT ISOLATION AND LOW PATTERN CORRELATION AND METHOD OF MAKING SAME

FIELD OF THE DISCLOSURE

The present disclosure relates generally to a compact, multi-port, multiple-input and multiple-output (MIMO) antenna with high port isolation and low pattern correlation and to a method of making such an antenna.

BACKGROUND

As the use of smart phones, cellular telephones, and personal digital assistants, and like mobile devices in wireless communication systems continues to dramatically grow, a need exists to provide increased system performance. One technique for improving such system performance is to provide uncorrelated propagation paths using multiple-input and multiple-output (MIMO) smart antenna technology. MIMO uses multiple transmitting antennas, which are typically spatially arranged apart, at a transmitter for simultaneously transmitting spatially multiplexed signals along multiple propagation paths; and multiple receiving antennas, which are also typically spatially arranged apart, at a receiver to demultiplex the spatially multiplexed signals. MIMO technology offers significant increases in data throughput and system range without additional bandwidth or increased transceiver power by spreading the same total power over the multiple antennas. MIMO is an important part of modern wireless communication standards, such as at least one version of IEEE 802.11 (Wi-Fi), 4G, 3GPP Long Term Evolution (LTE), WiMax and HSPA+.

However, the use of multiple antennas results in an unfavorable trade-off between device size and system performance. Effective MIMO performance requires relatively high port isolation and low pattern correlation. This is typically accomplished by increasing the distance between the antennas, thereby resulting in larger devices, which are undesirable in many applications, such as handheld mobile devices or Wi-Fi access points. Although decreasing the distance between the antennas results in a desirably smaller device, it is typically obtained at the expense of higher pattern correlation, lower port isolation, and poorer performance caused by mutual coupling. Mutual coupling between the antennas typically results in wasted transmit power during transmission, and a lower received power from incoming signals during reception.

Accordingly, there is a need for a compact, multi-port, MIMO antenna with the characteristics of high port isolation and low pattern correlation for enhanced performance, as well as to a method of making such an antenna.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
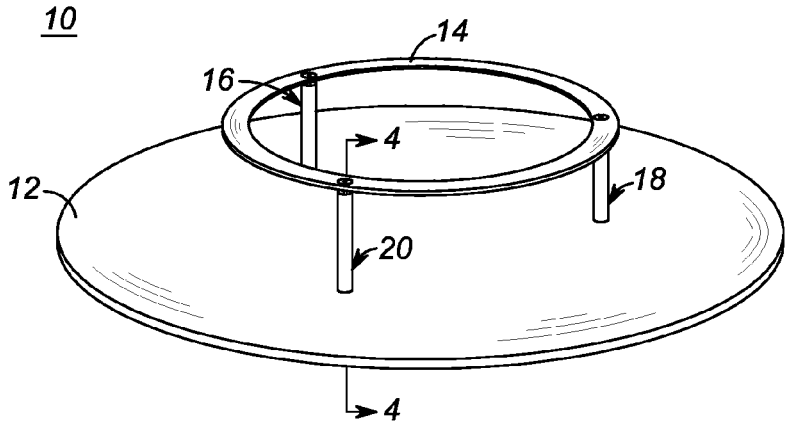
FIG. 1 is a perspective view of one embodiment of a compact, multi-port, MIMO antenna with high port isolation and low pattern correlation in accordance with the present disclosure.

Skilled artisans will appreciate that elements in the figures are illustrated for simplicity and clarity and have not necessarily been drawn to scale. For example, the dimensions and locations of some of the elements in the figures may be exaggerated relative to other elements to help to improve understanding of embodiments of the present invention.

The method and structural components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

One aspect of this disclosure relates to an antenna that includes a ground support, e.g., a ground plane; an electrically conductive, endless element, e.g., a circular element, mounted at a distance relative to the ground support; and a trio of ports arranged, preferably circumferentially, along the endless element for conveying radio frequency signals in an operating band of frequencies. The ports are successively spaced apart, preferably at equal electrical distances, along the endless element by a spacing of one-half of a wavelength at a center frequency of the operating band.

The wavelength referenced herein is the guided wavelength relative to an open transmission line formed, between the ports, by the endless element and the ground support. More particularly, this guided wavelength is such that a signal applied at one port undergoes a phase inversion to arrive at another port through the shortest connecting path therebetween along the endless element. Preferably, the endless element has a symmetrical shape about each port. For instance, each port could be located at a respective corner of an equilateral triangularly-shaped element, or at every other corner of an equilateral hexagonally-shaped element. Correspondingly, the trio of ports is arranged preferably equiangularly.

Also, preferably, the above-mentioned open transmission line formed between the ground support and the endless element features constant characteristic impedance. When this condition is met, a radio frequency signal fed at any one port will split approximately equally in opposite directions along the endless element. This signal split is exactly equal if the input impedance seen on either side of each port is the same. One split signal will arrive at an adjacent port a half wavelength away (180 degrees phase shift) along the shorter connecting path, while the other split signal will arrive at the same adjacent port a full wavelength away (360 degrees phase shift) along the longer connecting path. The split signals are thus in opposite phase at the same adjacent port. Thus, there is a high (near ideal) port isolation between the ports, and a corresponding low pattern correlation between the respective radiated electromagnetic field patterns, since it is well known that, for lossless antennas, coupling between the ports corresponds to pattern correlation, and the same is approximately true for low-loss antennas. Antennas are typically designed to have low ohmic losses, and thus a high efficiency in order to maximize communication range and data throughput rate.

Low pattern correlation yields a high data throughput in MIMO communication systems. Other known means may be used that can concurrently achieve phase inversion and approximately equal amplitude when transmitting between any pair of ports of a three-port antenna structure, to thereby produce high port isolation and low pattern correlation. For instance, it may be possible to load sections of the endless element with distributed or lumped resistive and reactive components in order to obtain the so desired phase and amplitude relationships. In this case, the endless element may be mechanically discontinuous if series elements, e.g., capacitors, are placed along its contour in order to achieve said phase relationships.

In a preferred embodiment, the ground support has an outer contoured support surface, e.g., flat or curved, and the endless element has an outer antenna surface of complementary contour, i.e., also flat or curved, relative to the contoured support surface. At any given point along the endless element, the outer antenna surface has preferably a constant dimension, e.g., width, if the endless element is formed by a strip-like structure, in the direction orthogonal to the direction along which the endless element develops, as well as the direction crossing said point and orthogonal to the ground support, and is preferably maintained at a constant distance from the outer contoured support surface.

In this way, the characteristic impedance of the transmission line formed by the endless element and the ground support is maintained essentially constant, thus substantially facilitating the energy flow and the determination of the distance between the ports, because the guided wavelength is essentially constant. For instance, the distance between the endless element and the ground support can be selected and adjusted to yield a 50 ohm impedance match at each port, as it happens, for instance, if the input impedance seen on either side of each port along the endless element is 100 ohms Advantageously, the endless element radiates radio frequency waves in an operating band of frequencies, e.g., 2.40 GHz to 2.48 GHz, and also radiates radio frequency waves in an additional operating band of higher frequencies, e.g., 5 GHz to 6 GHz, thereby allowing a wireless device to operate across the most common Wi-Fi frequency bands world-wide.

A method of making an antenna, in accordance with another aspect of this disclosure, is performed by mounting an electrically conductive, endless element at a distance relative to a ground support; arranging a trio of ports along the endless element for conveying radio frequency signals in an operating band of frequencies; and successively spacing the ports apart along the endless element by a spacing of one-half of a guided wavelength at a center frequency of the operating band.

Turning now to FIGS. 1-4 of the drawings, reference numeral 10 generally identifies a first embodiment of a compact, three-port, multiple-input and multiple-output (MIMO) antenna with high port isolation and low pattern correlation. Antenna 10 includes a ground support, which is configured as a ground plane 12; an electrically conductive, endless element, which is configured as a flat ring or circular element 14, that is mounted at a constant distance relative to the ground plane 12; and a trio of ports 16, 18, 20 that are equiangularly arranged along the circumference of the circular element 14 for conveying radio frequency signals in an operating band of frequencies, e.g., 2.40 GHz to 2.48 GHz. Adjacent ports 16, 18, 20 are successively spaced circumferentially apart along the circular element 14 by a spacing of one-half of a guided wavelength ($\lambda/2$) at a center frequency, e.g., 2.44 GHz, of the operating band. The circumference of the circular element 14 is $3\lambda/2$. This numerical operating band of frequencies is merely exemplary. It will be understood that different operating frequency bands and different operating frequency ranges, as described below, could also be used.

Figure 3:
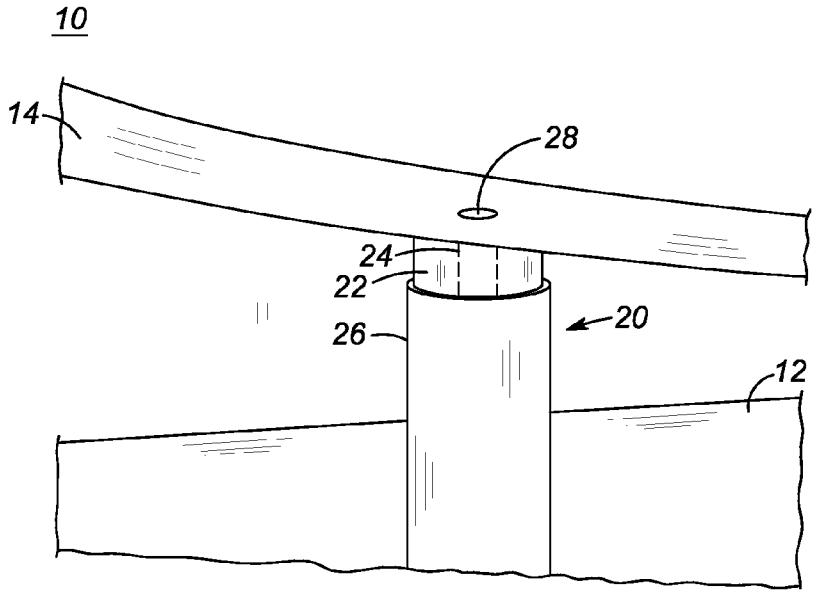
FIG. 3 is a close-up, perspective view of a detail of the embodiment of FIG. 1.
Figure 4:
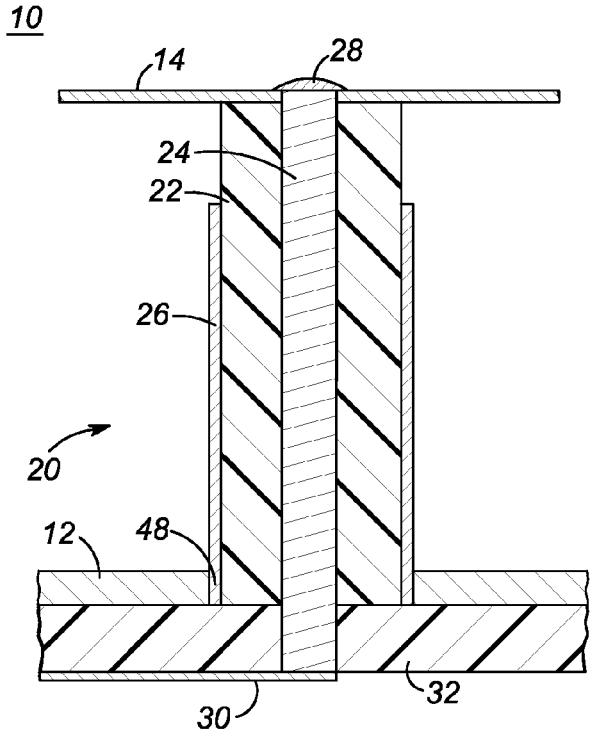
FIG. 4 is an enlarged, sectional view taken on line 4-4 of FIG. 1.

As shown in FIGS. 3-4 for representative port 20, in a preferred embodiment, each port includes an electrically insulating component or dielectric 22, e. g., constituted of Teflon, for holding the circular element 14 at the distance; an electrical center conductor 24 extending through the dielectric 22 and galvanically connected, or electromagnetically coupled, to the circular element 14; and an electrically shielding component or outer electrically conductive shield 26 surrounding the dielectric 22 and shielding the electrical conductor 24. Evidently, in this embodiment, the center conductor 24, the dielectric 22, and the conductive shield 26 form a coaxial cable. This cable, if sufficiently rigid, provides the mechanical function of suspending and supporting the circular element 14 above the ground plane 12. In the preferred embodiment of FIG. 4, which is an enlarged, sectional view taken on line 4-4 of FIG. 1, an upper end of the conductor 24 extends through a hole that extends through the circular element 14 and is soldered at weld joint 28. A lower end 48 of the conductive shield 26 is galvanically connected to the ground plane 12. A lower end of the conductor 24 extends through a hole in the ground plane 12, the hole having a diameter approximately equal to the inner diameter of the conductive shield 26. The lower end of the conductor 24 extends through the ground plane 12 and, as illustrated in FIG. 4, is electrically connected to a microstrip feed line 30 on a dielectric substrate 32 provided at the underside of the ground plane 12. It will be understood that a different feed arrangement, such as a coaxial cable and a pair of connectors for each port, could also be used instead of the microstrip arrangement to feed a signal to the conductor 24.

Figure 2:
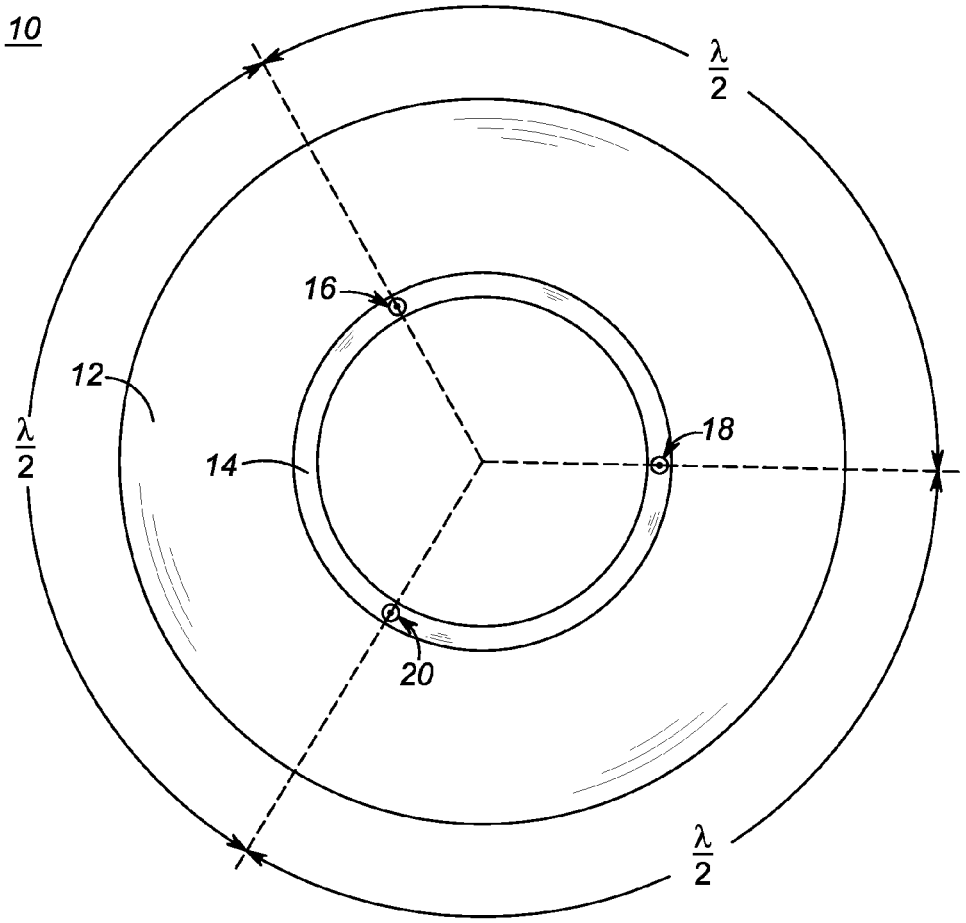
FIG. 2 is a top plan view of the embodiment of FIG. 1.

In a preferred embodiment, the ground plane 12 has an outer contoured support surface, and the circular element 14 has an outer antenna surface of complementary contour to the contoured support surface. As shown in the embodiment of FIGS. 1-3, the circular element 14 is planar and its outer antenna surface is generally parallel to, and at approximately a constant distance relative to, the outer planar support surface of the ground plane 12. The circular element 14 is maintained at the aforementioned constant distance from the ground plane 12 by the dielectric 22 of each port 16, 18, 20. The constant distance between the circular element 14 and the ground plane 12 is selected and/or adjusted, as described below, to produce a desired impedance match, e.g., 50 ohms, at each port 16, 18, 20 to efficiently radiate/receive radio frequency power at any of the ports.

In an exemplary embodiment, the circular element 14 is constituted of a metal, such as steel, preferably with a gold or nickel plating. When operative at the operating band of frequencies, e.g., 2.40 GHz to 2.48 GHz, the circular element 14 has a width of about 1-5 mm, preferably about 2-3 mm, and is maintained at the distance of about 17 mm relative to the ground plane 12 to obtain approximately the desired 50 ohm impedance match. The aforementioned spacing of one-half of a guided wavelength between adjacent ports, along the circular element 14, is about 57.5 mm.

In use as a transmitting antenna, a plurality of radio frequency sources together with antenna matching circuits (not illustrated), preferably one matching circuit for each port, are mounted at the opposite side of the ground plane 12, preferably between the microstrip line 30 and the center conductor 24. Each source generates a radio frequency signal that is conducted along the respective microstrip line 30 to the respective center conductor 24, through a matching circuit, if needed, and to the circular element 14. Thus, each radio frequency signal is fed to each port, preferably simultaneously, and is radiated from the entire circular element 14. The three ports, so decoupled, serve as three independent channels. The radio frequency signal emitted at any one port, e.g., port 16, will split equally in opposite circumferential directions along the circular element 14. One split signal will arrive at an adjacent port, e.g., port 18, a half wavelength away (180 degrees out of phase), while the other split signal will arrive at the same adjacent port 18 a full wavelength away (360 degrees; thus, in phase). The same analysis is valid for any other pair of neighboring ports. The split signals thus feature opposite phases, and cancel each other out, at the same adjacent port 18. Due to symmetry, all three ports have the same properties.

Thus, there is a high (near ideal) port isolation between the ports 16, 18, across the aforementioned narrow fractional operating band, and a corresponding low pattern correlation between the radiated electromagnetic patterns, provided that the ohmic losses of the antenna are moderate. This yields a high data throughput and an enhanced antenna performance in MIMO wireless communication systems, for instance, Wi-Fi devices operating under at least one version of the IEEE 802.11 standard. Advantageously, the circular element 14 is a dual-band antenna and radiates radio frequency waves not only in the aforementioned operating band of frequencies, e.g., 2.40 GHz to 2.48 GHz, but also efficiently radiates radio frequency waves in an additional operating band of higher frequencies, e.g., 5 GHz to 6 GHz, thereby making the antenna especially desirable for use in dual-band, wireless, Wi-Fi routers.

Figure 5:
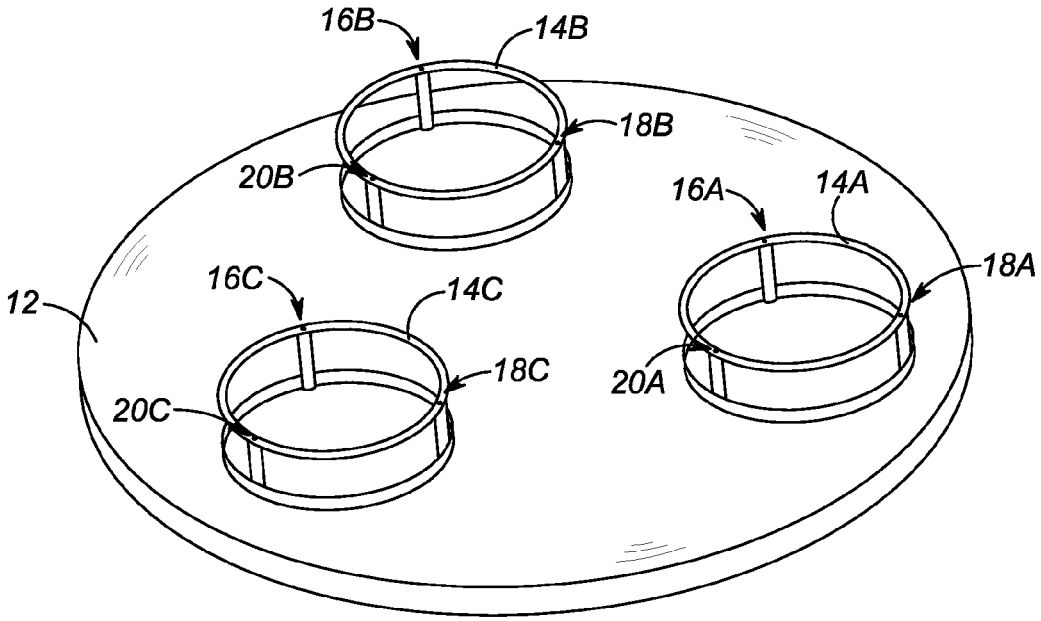
FIG. 5 is a perspective view of another embodiment of a compact, multi-port, MIMO antenna with high port isolation and low pattern correlation in accordance with the present disclosure.

FIGS. 5-8 depict variations of the antenna. In the embodiment of FIG. 5, the ground support 12 is large enough to accommodate and support three circular elements 14A; 14B; and 14C, each with its own set of respective ports 16A, 18A, 20A; 16B, 18B, 20B; and 16C, 18C, 20C. As illustrated, the antennas are translated in position relative to one another, i.e., the same numbered ports have the same angular positions relative to the ground support 12. As an example, the ports 18A, 18B, 18C all face generally rightwardly and downwardly in FIG. 5. It will be understood that the antennas could also be rotated in position relative to one another, i.e., the same numbered ports have different relative positions relative to the ground support 12. This rotation is about an axis that is perpendicular to the ground support 12 and is centrally located within the respective endless element 14A, 14B, and 14C. As an example, the port 18B could be located in either the illustrated position of port 20B or port 16B. It will be further understood that one or more of the antennas in FIG. 5 could be translated and rotated.

Figure 6:
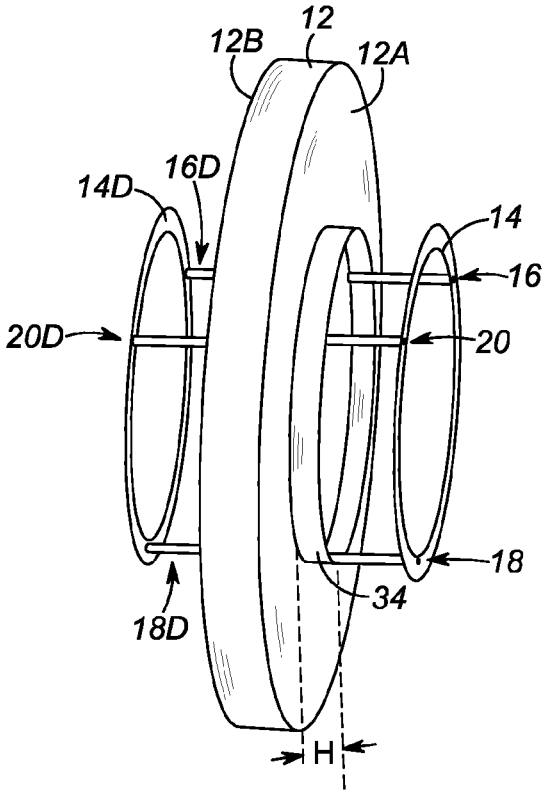
FIG. 6 is a perspective view of still another embodiment of a compact, multi-port, MIMO antenna with high port isolation and low pattern correlation in accordance with the present disclosure.

In the embodiment of FIG. 6, the circular element 14 and its ports 16, 18, 20 are mounted at one side 12A of the ground support 12, and an additional circular element 14D and its ports 16D, 18D, 20D are mounted at an opposite side 12B of the ground support 12. The additional ports 16D, 18D, 20D are arranged along the additional circular element 14D for conveying radio frequency signals in one or multiple operating bands of frequencies. The additional ports 16D, 18D, 20D are spaced apart along the additional circular element 14D by a spacing of one-half of a guided wavelength at the center frequency of an operating band. Although the ports 16, 16D; ports 18, 18D; and ports 20, 20D are illustrated as being aligned, i.e., collinear, it will be understood that one of the antennas could be rotated about an axis that is perpendicular to the ground support 12 and is centrally located within the respective endless element 14 and 14D. The back-to-back configuration of the embodiment of FIG. 6 provides six ports with high port isolation and can advantageously be positioned on corridor walls to provide independent Wi-Fi zones in opposite directions of the corridor. Furthermore, the double-faced ground support 12 of FIG. 6 can be hollow and thick enough to contain Wi-Fi router circuitry, batteries, and the like, thereby forming a wholly functional device.

The embodiment of FIG. 6 also depicts an annular adjustment element 34 fixedly mounted on the ground support 12 for adjusting the distance between the circular element 14 and the ground support 12 to achieve the aforementioned 50 ohm impedance match. The adjustment element 34 may be one of a set of such adjustment elements of different heights. A user selects an adjustment element 34 of the proper height (H), thereby setting the constant distance between the circular element 14 and the ground support 12 to an optimum value. In a preferred embodiment, the adjustment element 34 has a thin cross-section and is galvanically connected to the ground support 12 and to the conductive shield 26 of each port. This adjustment element 34 may be used in any of the other disclosed antenna embodiments.

Furthermore, other embodiments of the adjustment element 34 may include the case where the adjustment element 34 is suspended between the ground support 12 and the circular element 14. For instance, the adjustment element 34 may be galvanically connected to the conductive shield 26 of each port and be supported mechanically by each conductive shield 26 at some distance from the ground support 12, and at another distance from the circular element 14.

Figure 7:
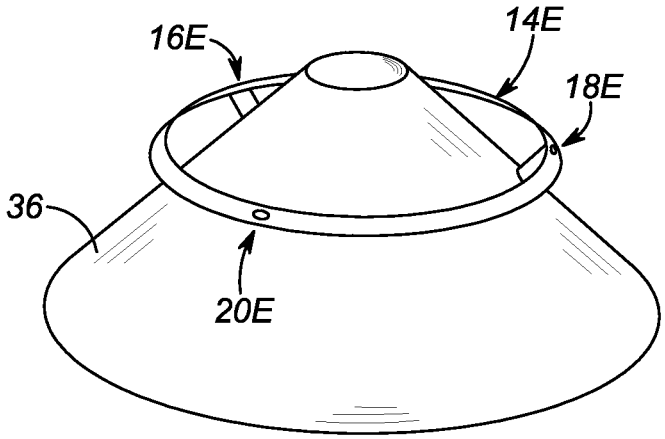
FIG. 7 is a perspective view of yet another embodiment of a compact, multi-port, MIMO antenna with high port isolation and low pattern correlation in accordance with the present disclosure.
Figure 8:
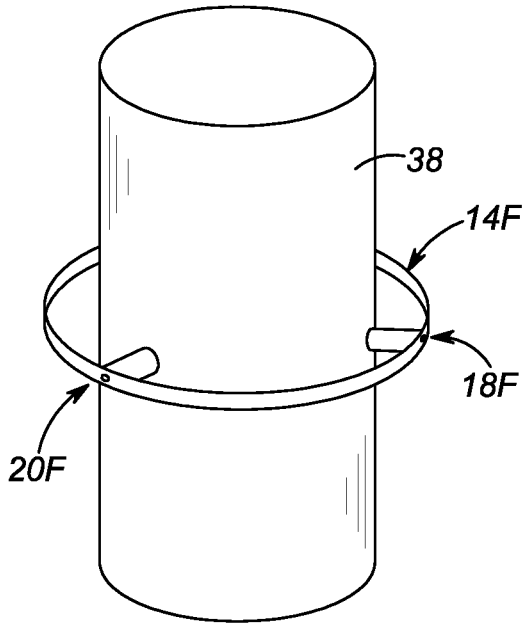
FIG. 8 is a perspective view of an additional embodiment of a compact, multi-port, MIMO antenna with high port isolation and low pattern correlation in accordance with the present disclosure.

The ground support 12 need not lie in a plane, but, as illustrated in the embodiments of FIGS. 7-8, may be curved. In FIG. 7, the ground support is a frustoconical support 36. In FIG. 7, the ground support is a cylindrical support 38. In these preferred embodiments, the outer antenna surface of the circular element is of complementary contour with, and maintained at a constant distance from, the outer contoured support surface. Hence, in FIG. 7, the circular element 14E (associated with ports 16E, 18E, 20E) is likewise conically shaped, and, in FIG. 8, the circular element 14F (associated with ports 16F (hidden), 18F, 20F) is likewise cylindrically shaped.

Figure 9:
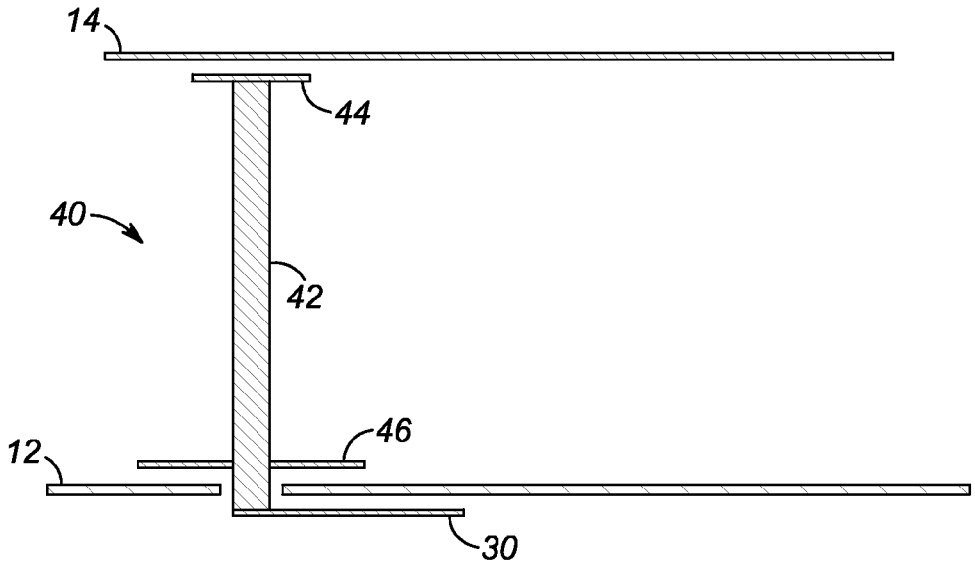
FIG. 9 is a sectional view analogous to FIG. 4 of a further embodiment of a compact, multi-port, MIMO antenna with high port isolation and low pattern correlation in accordance with the present disclosure.

FIG. 9 is a view analogous to FIG. 4, but depicting another preferred embodiment, in which the endless element 14 is again suspended above a ground plane 12. However, in contrast to the above-described coaxial cable configuration of the representative port 20 in FIG. 4, the representative port 40 in FIG. 9 is configured as a solid metal post 42. An upper metal disk 44 at or adjacent the top of the post 42 is spaced from the endless element 14 and serves as a series capacitor therewith. A dielectric (not illustrated so as to simplify the drawing) is located between the disk 44 and the endless element 14 to support the latter. A lower metal disk 46 at or adjacent the bottom of the post 42 is spaced from the ground plane 12 and serves as a shunt capacitor therewith. A dielectric (not illustrated so as to simplify the drawing) is located between the disk 46 and the ground plane 12. The size and spacing of these disks 44, 46, as well as the permittivity of the aforementioned dielectrics, control the value of their capacitances and are employed to optimize the aforementioned impedance match, and may replace the aforementioned adjustment element 34. The post 42 in FIG. 9 extends through the ground support 12, and the bottom end of the post 42 is galvanically connected to the aforementioned microstrip feed line 30. Again, a dielectric support between the feed line 30 and the ground support 12 has been omitted so as not to encumber the drawing.

Figure 10:
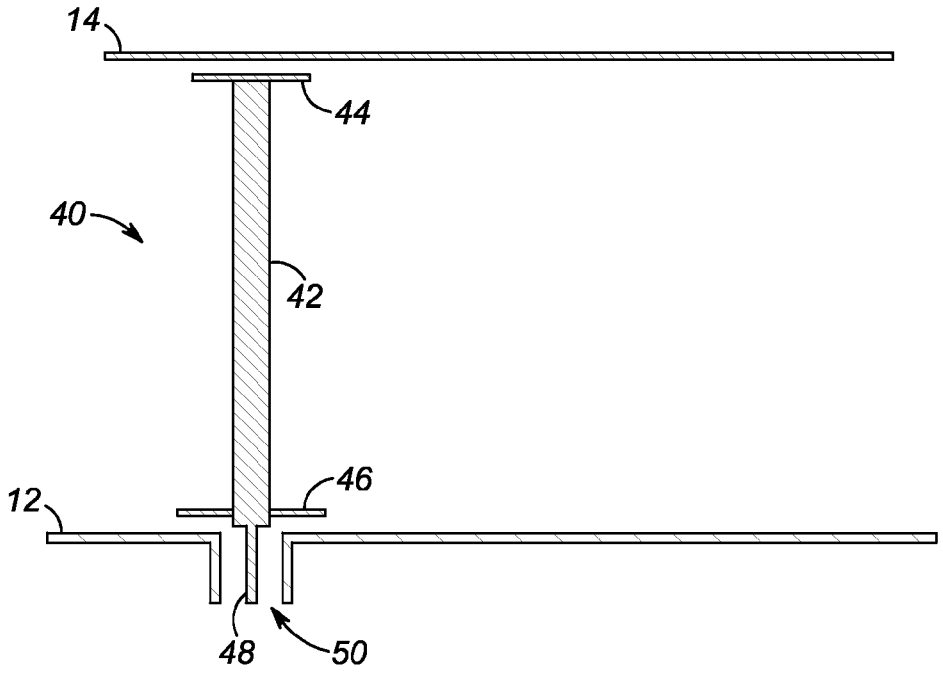
FIG. 10 is a view analogous to FIG. 9, but showing a different physical embodiment providing a signal feed.

FIG. 10 is a view analogous to FIG. 9, but depicting another preferred embodiment, in which a conductor 48 at the bottom of the post 42 extends through the ground plane 12, and an RF connector 50 is used to feed a signal to port 40.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing," or any other variation thereof, are intended to cover a non-exclusive inclusion, such that a process, method, article, or apparatus that comprises, has, includes, contains a list of elements does not include only those elements, but may include other elements not expressly listed or inherent to such process, method, article, or apparatus. An element proceeded by "comprises . . . a," "has . . . a," "includes . . . a," or "contains . . . a," does not, without more constraints, preclude the existence of additional identical elements in the process, method, article, or apparatus that comprises, has, includes, or contains the element. The terms "a" and "an" are defined as one or more unless explicitly stated otherwise herein. The terms "substantially," "essentially," "approximately," "about," or any other version thereof, are defined as being close to as understood by one of ordinary skill in the art, and in one non-limiting embodiment the term is defined to be within 10%, in another embodiment within 5%, in another embodiment within 1%, and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors, and field programmable gate arrays (FPGAs), and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein, will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. An antenna comprising:

a frustoconical ground support having a first contoured surface;

an electrically conductive, endless element mounted at a distance from the ground support, the endless element having a second contoured surface that is complementarily contoured to the first contoured surface; and a trio of ports arranged along the endless element for conveying radio frequency signals in an operating band of frequencies, the ports being successively spaced apart along the endless element by a spacing defined by a wavelength associated with the operating band.

2. The antenna of claim 1, wherein:

the first contoured surface is curved; and the second contoured surface is curved and maintains a substantially constant distance from the first contoured surface.

3. The antenna of claim 1, wherein:

the endless element extends around a circle and is circumferentially complete; and the ports are equiangularly spaced apart along a circumference of the circle.

4. The antenna of claim 1, further comprising an adjustment element having a predetermined height selected for achieving a desired impedance match is fixedly mounted on the ground support for adjusting the distance to the endless element via the predetermined height.

5. The antenna of claim 1, further comprising an adjustment element having a predetermined height selected for achieving a desired impedance match is connected to the ports for adjusting the distance to the endless element and to the ground support via the predetermined height.

6. The antenna of claim 1, wherein each port includes:

an electrically insulating component for holding the endless element at the distance;

an electrical conductor extending through the insulating component and electrically connected to the endless element; and an electrically shielding component surrounding the insulating component and shielding the electrical conductor.

7. The antenna of claim 1, wherein:

each port includes:

an elongated electrically conductive post; and upper and lower conductive elements mounted in spaced apart relation on the post;

the upper conductive element is spaced from the endless element; and the lower conductive element is spaced from the ground support, to achieve a desired impedance match.

8. The antenna of claim 1, wherein the endless element is mounted at one side of the ground support, and further comprising:

an additional endless element mounted at an opposite side of the ground support; and an additional trio of ports arranged along the additional endless element for conveying radio frequency signals in the operating band of frequencies, the additional ports being spaced apart along the additional endless element by a spacing of one-half of the guided wavelength at the center frequency of the operating band.

9. A method of making an antenna comprising:

mounting an electrically conductive, conically-shaped endless element at a distance from a frustoconical ground support having a first contoured surface;

arranging a trio of ports along the endless element for conveying radio frequency signals in an operating band of frequencies; and successively spacing the ports apart along the endless element by a spacing defined by a wavelength associated with the operating band, the endless element have a second contoured surface that is complementarily contoured to the first contoured surface.

10. The method of claim 9, further comprising:

configuring the first contoured surface to be curved; and configuring the second contoured surface to be curved and to be maintained at a substantially constant distance from the first contoured surface.

11. The method of claim 9, further comprising:

configuring the endless element to extend around a circle and to be circumferentially complete; and equiangularly spacing the ports apart along a circumference of the circle.

12. The method of claim 9, further comprising adjusting the distance to the endless element by fixedly mounting an adjustment element on the ground support, the adjustment element having a predetermined height selected for achieving a desired impedance match.

13. The method of claim 9, further comprising adjusting the distance to the endless element and to the ground support by connecting an adjustment element to the ports, the adjustment element having a predetermined height selected for achieving a desired impedance match.

14. The method of claim 9, further comprising:

holding the endless element at the distance with an electrically insulating component;

electrically connecting an electrical conductor to the endless element by extending the electrical conductor through the insulating component; and surrounding the insulating component and shielding the electrical conductor with an electrically shielding component.

15. The method of claim 9, further comprising:

mounting upper and lower conductive elements in spaced apart relation on an elongated electrically conductive post;

spacing the upper conductive element from the endless element; and spacing the lower conductive element from the ground support in accordance with a desired impedance match.

16. The method of claim 9, wherein the mounting of the endless element is performed at one side of the ground support, and further comprising:

mounting an additional endless element at an opposite side of the ground support;

arranging an additional trio of ports along the additional endless element for conveying radio frequency signals in the operating band of frequencies; and spacing the additional ports apart along the additional endless element by a spacing of one-half of the guided wavelength at the center frequency of the operating band.

* * * * *